US006847018B2

(12) United States Patent
Wong

(10) Patent No.: US 6,847,018 B2
(45) Date of Patent: Jan. 25, 2005

(54) FLEXIBLE HEATING ELEMENTS WITH PATTERNED HEATING ZONES FOR HEATING OF CONTOURED OBJECTS POWERED BY DUAL AC AND DC VOLTAGE SOURCES WITHOUT TRANSFORMER

(76) Inventor: Chon Meng Wong, 34 Mark Dr., Lincoln, RI (US) 02865-4007

( * ) Notice: Subject to any disclaimer, the term of this patent is extended or adjusted under 35 U.S.C. 154(b) by 24 days.

(21) Appl. No.: 10/373,421

(22) Filed: Feb. 25, 2003

(65) Prior Publication Data

US 2003/0183620 A1 Oct. 2, 2003

Related U.S. Application Data

(60) Provisional application No. 60/359,373, filed on Feb. 26, 2002.

(51) Int. Cl.[7] ..... H05B 3/54

(52) U.S. Cl. ..... 219/549; 219/505; 338/309

(58) Field of Search ..... 219/505, 507, 219/541, 549, 475, 481, 488, 219; 338/308, 309; 307/72

(56) References Cited

U.S. PATENT DOCUMENTS 4,205,223 A * 5/1980 Cole ..... 219/501
4,271,671 A * 6/1981 Smeets ..... 60/578
5,118,458 A 6/1992 Nishihara et al.
5,173,587 A * 12/1992 Nakano et al. ..... 219/212
5,406,049 A * 4/1995 Reiser et al. ..... 219/219
5,516,189 A * 5/1996 Ligeras ..... 297/180.11
5,523,873 A 6/1996 Bradford, III et al.
5,861,902 A 1/1999 Beerling
5,882,722 A 3/1999 Kydd
5,994,997 A * 11/1999 Brown et al. ..... 338/309
6,057,610 A * 5/2000 Nierescher ..... 307/72
6,084,217 A * 7/2000 Bulgajewski ..... 219/505
6,146,480 A 11/2000 Centanni et al.
6,218,647 B1 * 4/2001 Jones ..... 219/501
6,310,332 B1 * 10/2001 Gerrard ..... 219/505
6,512,203 B2 * 1/2003 Jones et al. ..... 219/219

* cited by examiner

*Primary Examiner*—Robin O. Evans
*Assistant Examiner*—Leonid M Fastovsky
(74) *Attorney, Agent, or Firm*—Steptoe & Johnson LLP

(57) ABSTRACT

A heating element made from flexible circuit technology with a single contiguous heating zone for uniform heating or multiple temperature heating zones is described. These flexible heating elements can conform to three dimensional object surfaces with irregular shape. The heating element's overall flexibility and its thickness (in the region of 10 mils) allow for heating many object shapes in an efficient, compact and light-weight manner. Each thermal sensor or thermostat is used to regulate each heating zone and provide a unique temperature setting. A thermostat can be mounted directly on an object's metallic surface. In addition, using diodes connected to the flexible heating element is described here to allow the use of two or multiple voltage sources. The technique permits one heating element to be powered from either AC or DC sources with comparable heating characteristics from both. The technique also eliminates the use of a transformer, which makes the heating solution simple and particularly compact and lightweight.

8 Claims, 7 Drawing Sheets

FLEXIBLE HEATING ELEMENTS WITH PATTERNED HEATING ZONES FOR HEATING OF CONTOURED OBJECTS POWERED BY DUAL AC AND DC VOLTAGE SOURCES WITHOUT TRANSFORMER

CROSS-REFERENCE TO RELATED APPLICATIONS

The present application claims priority under 35 U.S.C. § 119 (e) to U.S. Provisional Patent Application Ser. No. 60/359,373, filed on Feb. 26, 2002, the disclosure of which is expressly incorporated by reference herein in its entirety.

BACKGROUND OF THE INVENTION

1. Field of Invention

The invention relates to a heating element. More particularly, the invention relates to a flexible heating element especially suitable for heating solids or liquids.

2. Background

Flexible circuits have been used for different types of heating processes. The use of flexible circuits for heating in a molded form is described in U.S. Pat. No. 5,118,458 Nishihara, et al., Jun. 2, 1992 ("Method For Molding An Article Integrated With A Multi-Layer Flexible Circuit And An Apparatus For Carrying Out The Method"). Another use of flexible circuits for heating is described in U.S. Pat. No. 5,523,873 by Bradford, III, et al., Jun. 4, 1996. Beerling finds another method of flexible circuit as heater for inkjet application is found in U.S. Pat. No. 5,861,902, Jan. 19, 1999.

SUMMARY OF THE INVENTION

A heating element uses patterned copper or aluminum surfaces on an insulating laminate. Contiguous regions of etched copper or aluminum define isothermal regions. This method allows different heating elements to heat and conform to the shape of the object it is heating. The isothermal region can be irregular in shape and conform to a three-dimensional object surface. A thermal sensor or thermostat controls each temperature zone. Multiple heating zones can be obtained easily.

The contiguous copper or aluminum zones are electrically isolated from the resistive heating elements and therefore are electrically safe to be in contact with the object it wraps around. The heated object can be liquid or metallic.

In addition, a method of using diodes is described that allows the same heating element to be powered by different voltage sources, such as from a 110 VAC outlet or 12 VDC automotive source. This method provides comparable heating characteristics for both voltage sources and eliminated the use of bulky transformers.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings.

DETAILED DESCRIPTION OF THE EXEMPLARY EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

This invention relates to methods of fabricating a heating element capable of uniformly heating an object using polymer thick film technology (PTF) or etched conductive film technology on a laminated substrate. The heating element is a thin flexible circuit that can be wrapped around an irregularly-shaped object. Copper foils, aluminum foils, or other thermal conductor are used to transfer heat to the required object.

In addition, this invention also addresses the method of making a heating element (whether a flexible circuit or other element) to dissipate the same amount of heat power under different supply voltages without using any transformer or voltage translation device. This method is particularly useful in portable heating products where the source of heating can be different. Bulky transformers are eliminated. In such cases the heating characteristics of the heating element should remain relatively constant whether it is connected to an alternating current outlet (e.g., 110V rms) in an indoor environment or a direct current source such as an automotive (e.g., 12~14V dc) power source. Additional advantages for this invention are that the heating element can be lightweight, compact in size, and energy efficient. The flexible heating element may cover the entire area to be heated, yet its overall thickness can be around 10 mils. Conventional methods use different heating elements for different voltage sources, so heating images may differ. Both voltage sources may be used with the disclosed heating element. Therefore the exact heating image or characteristics for both power sources are comparable. The topological pattern normally dictates the resistance through Ohm's law.

Figure 1:
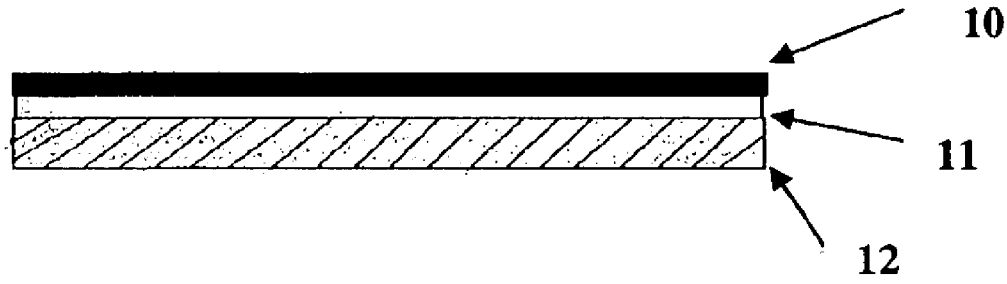
FIG. 1 illustrates a cross section of a base material laminate with one-sided copper foil, with an adhesive layer, and an insulating film.
Figure 2:
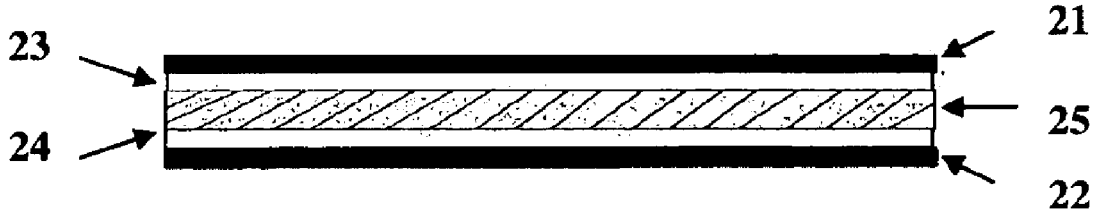
FIG. 2 illustrates a cross section of a base material laminate with two-sided copper foil, an adhesive layer, and an insulating film.

FIG. 1 illustrates a cross section of a base material laminate. An adhesive layer 11 joins a copper foil 10 with an insulating film 12. FIG. 2 illustrates a cross section of an alternate base material laminate. A first adhesive layer 23 joins a first layer of copper foil 21 to an insulating film 25, while a second adhesive layer 24 joins a second layer of copper foil 22 to the insulating film 25.

Figure 3:
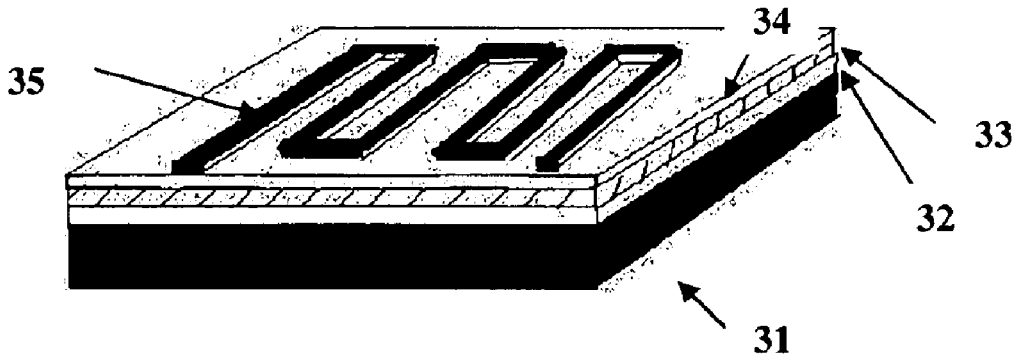
FIG. 3 illustrates a double-sided copper foil laminate with a copper side etched to form a resistive heating element.

FIG. 3 illustrates a double-sided laminate as in FIG. 2, but with one copper foil 35 etched to form a heating element.

The second copper foil 31 forms a single, contiguous isothermal zone. In this case there is one resistance heater and one zone. Layers 32 and 34 are adhesive. Layer 33 is the insulating film.

Figure 4:
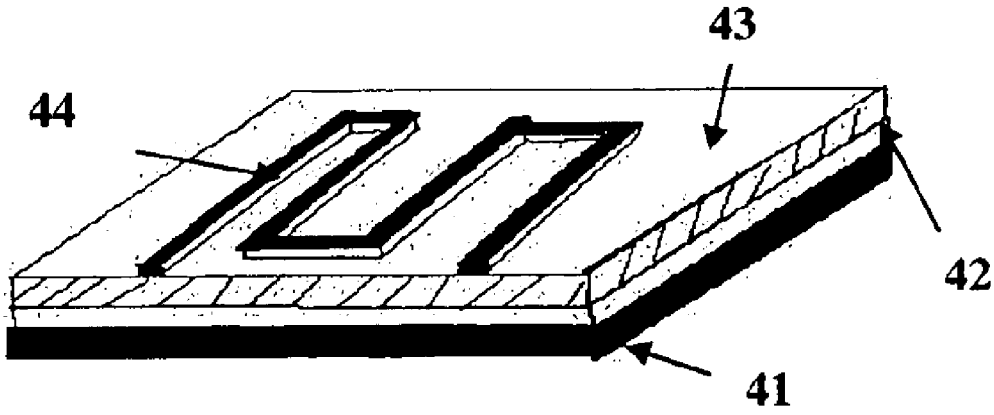
FIG. 4 illustrates a single-sided copper foil laminate with PTF conductive ink printed on an insulating film to form a resistive heating element.

FIG. 4 illustrates a double sided laminate similar to the one of FIG. 1 but with a heating element made from conductive ink 44 printed on to the insulating film 43. Copper foil 41 forms an isothermal zone. The copper foil 41 may be etched to form a zone of a desired shape. In this case there is one resistance heater and one zone. Layer 42 is an adhesive layer. Layer 43 is the insulating film.

Figure 5:
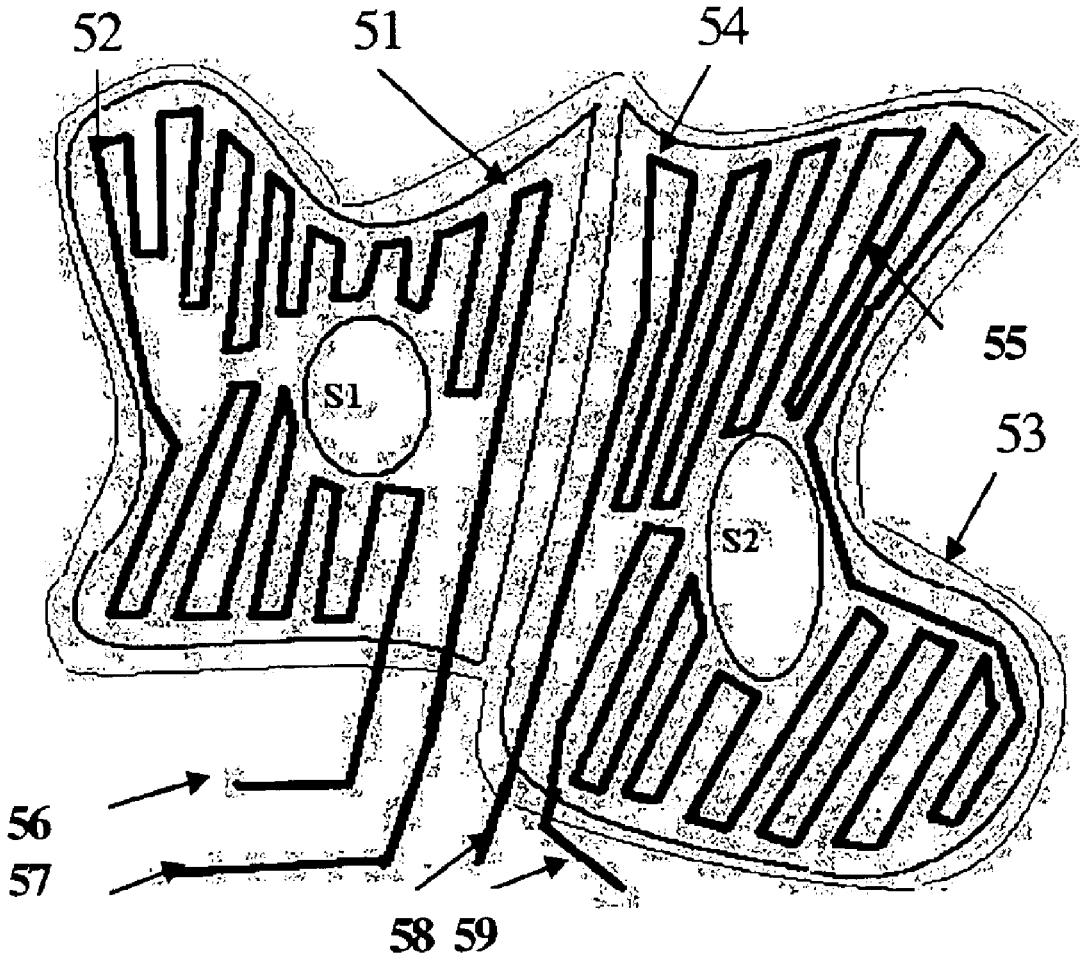
FIG. 5 illustrates a contoured heating element with two isolated copper islands and two sensor regions S1 and S2 respectively.

FIG. 5 illustrates a contoured heating element with two heating zones. The element has two isolated copper islands 51, 54 adhered to one side of an insulating film 53 and two resistive elements 52, 55 printed or etched on the other side of insulating film 53. Each copper island forms a separate heating zone controlled by a sensor located in a respective temperature sensor region S1, S2. Each resistive element is separately connected electrically via flexible circuit connectors 56, 57, 58, 59 to a respective external power source. The external power sources may be the same. Copper islands 51, 54 can be contoured to any shape, preferably to wrap around and contact the object being heated. Thermally conductive paste, films or sprays may be applied before wrapping the heater around the object to be heated. If the object surface is highly thermally conductive, such as metallic surface, the sensor regions S1, S2 may be hollow to allow sensors to directly contact the object surface.

Such heaters are ideal for food warmers, mirror defoggers, biological incubators, seat warmers, water boilers, warmers of organic solid or liquid phase fluids, beverage warmers (e.g., for milk or coffee), de-icers for vehicles such as cars or planes, defoggers for vehicles such as cars or planes, de-icers or de-foggers for stationary objects such as windows, etc.

The finished heating element may be of various sizes and shapes. For example, the heating element may range in size from less than one square centimeter in area for small application, to as big as an entire airplane for de-icing applications. The heating element may be several square inches or feet for moderate sized applications. The heater may be formed in virtually any shape, including square, round, rectangular, circular, or combinations of shapes. The actual resistive/conducting heating element may also comprise substantially the area of the finished product. Alternately, the resistive conducting heating element may comprise only a portion of the product.

Commercially available films like Kapton, Ultem, Kaladex, Mylar, etc. may be used for lamination to produce the insulating film. The isothermal material may be a metallic laminate made of half-ounce to two-ounce copper or aluminum foil. Note that 0.5 ounce copper is 0.7 mils thick, 1 ounce copper is 1.4 mils thick, and 2 ounce copper is 2.8 mils thick. Other foil thickness is also possible, but the heat dispersion characteristics may be less effective if the thickness is reduced further. Flexibility may be lost if it is too thick. The insulator can be made of several materials such as Polyimide, PET, PEN, etc., depending on the temperature requirement. The insulating material thickness can vary and is preferably from half a mil (thousandth of an inch) to several mils. The thicker the material, the better the electrical insulation between the resistive layer and the copper foil, but thermal conductivity is reduced. Thermally matching or preshrunk materials are preferred to be used as laminate. Some laminating schemes are described as in U.S. Pat. No. 6,146,480 by Centanni et al., Nov. 14, 2000.

A copper or aluminum foil layer may be adhered to one surface of the insulating film for the purpose of being etched into a resistive heating element. Etching is a subtractive technology for making the resistor pattern. Another type of resistive heating conductive element is the Indium Tin Oxide (ITO). It is also classified as subtractive technology because etching is required. Unlike copper, ITO has very high sheet resistivity, but is optically transparent. The thickness of this foil can be half-ounce copper/aluminum/ITO or less and is determined by the heating element resistance value. A base starting material was shown in FIG. 2 for the laminate. FIG. 3 shows an etched serpentine resistive heating element pattern on the laminate.

An alternate method uses a polymer thick film (PTF) resistance heating element in place of the second layer of copper foil. FIG. 4 illustrates such a resistive element. The PTF ink adheres itself to the insulating film. This method is an additive technology. A printing process using conductive polymer thick film ink traces forms the heating element. The advantage is that the resistive heating element geometry can easily be designed to satisfy the power-resistance requirement. The heating element pattern should cover the defined iso-temperature contiguous region fully and maintain a uniform resistance per unit area. Spacing between conductive traces should be minimized. Furthermore, the resistance per unit length for PTF traces is at least several hundred times higher than that of the copper traces and therefore more easily satisfies the higher resistance value and the above design criteria. A layer or two of dielectric may be printed on top of the PTF resistive heating pattern as a mechanically protective and electrically insulative layer. This dielectric layer provides electrical safety, since the heating resistance can be connected to high voltage source. It also prevents moisture from entering and oxidizing the resistive element, which may degrade its resistance. A protection layer of insulate film can be laminated on the resistive element side to provide mechanical protection to the resistive elements from being scratched. All these protection layers must be able to withstand the operating temperature of the heating elements.

High thermal conductivity adhesive containing high thermally conductive and electrically insulating particles are used for adhering the insulating film to the copper foil. This adhesive material must also capable of withstanding the curing temperatures of the PTF ink. The Polymer Thick Film Ink can be based on several types, such as Silver Ink, Copper Ink, or Conductive Polymer Ink (See U.S. Pat. No. 5,882,722 by Kydd, Mar. 16, 1999, which uses electrical conductors formed from mixtures of metal powders and metallo-organic decompositions compounds) for producing the serpentine heater pattern. Other conductive ink manufacturers such as Dupont produce different types of PTF inks. The resistance should be such that it will meet the power heating requirements. For example, the heating requirement for a 220 W heater may be achieved by the Current×Voltage requirement (e.g., 110V×2 amperes). The corresponding resistance for this requirement is 55 ohms. This power relationship works for both direct current or alternating current schemes. At the same time, this heating requirement can be customized for several different regions to achieve different heating zones. Each zone is defined by the island of the copper and the resistance of the PTF ink on the insulated region opposite the copper island. FIG. 5 shows the two regions of copper islands 51 and 54. The heating resistive elements can be connected in parallel to a common voltage source. The conductive ink is covered with a layer of polymer dielectric and a subsequent layer of insulating laminating film such as Polyethylene Terephthalate Polyester (PET), PEN, Teflon, or Polyimide film. If pressure sensitive adhesive is used for laminating this insulating film, then it is possible to create adhesive tabs beyond the extent of the flexible circuits. These tabs are particularly useful for assembly purposes, such as attaching the flexible heater circuit to the object it heats. Some of these films and adhesives can withstand operating temperatures up to 400 degrees Celsius.

The use of such laminate and polymer thick film ink acting as heating elements printed on the insulator side is particularly useful for using as a unique heating element for an irregularly-shaped object, which requires the heating element to have a shape-matching contour. An applied voltage, whether alternating current or direct current, can be used to heat these PTF elements. The use of the polymer thick film on the insulated side of the copper flex laminate allows the heater design to be very efficient, flexible and its power dissipation per unit area adjustable to the required region. The contiguous region of the isolated copper islands from an etched design would define each heated region. The contiguous copper region ensures the localized PTF element temperatures to be diffused across the copper layer and achieve a uniform temperature. Each contiguous region can therefore have a separate thermal sensing element such as a thermostat, a semiconductor detector, etc.

Figure 6:
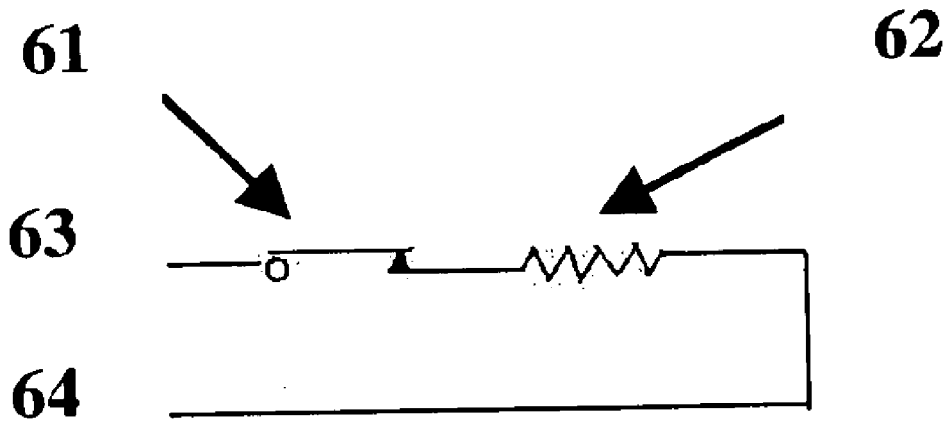
FIG. 6 illustrates the use of a thermostat as a temperature sensor to control a resistive heating element 62.

FIG. 6 shows the use of a thermostat 61 as a temperature sensor which cuts off the power when the final temperature is reached. An example of such a thermostat is the Klixon family of Thermostats, 7BT2LG. These are normally closed thermostats. Neighboring copper regions can have a separate thermostat set to a different temperature. The selection of these opening temperatures of the thermostat determines the maximum temperature the object can possibly see. However, if several copper regions are in contact with an external metallic surface, it is possible to mount the thermal sensor on the metallic surface to regulate its temperature. To improve the thermal conductivity to the metallic surface, thermal grease, paste or film may be used to fill any gap between the copper surface and the object's metallic surface. If there are several non-contiguous external isolated metallic surfaces, each surface can be mapped to one of the isolated copper areas for individual temperature settings.

The finished heating element may be used in a variety of temperatures. For example, the heating element may be used to warm material that is initially below freezing. It is contemplated that the heating element may be used to heat material that has temperature on the order of that of liquid nitrogen. Some embodiments may be used at temperatures of up to 400 degrees Celsius. Of course, any temperature between the lowest and highest aforementioned temperatures may be achieved. By way of non-limiting example, the heating element may be used to warm material such as water to its melting or boiling point.

Possible techniques for forming or cutting the materials either individually, in combination, or for the finished laminate include die cutting and laser cutting. Other cutting techniques may also be used.

Protective fuses (single blow or resettable) can be used in series with the circuit shown in FIG. 6. Single blow fuses such as Littlefuse in surface mount packages can be used. An example of a resettable fuse is the Tyco family of polyswitches. These fuses will ensure the power to the heating element be cut off should there be a short circuit.

Figure 7:
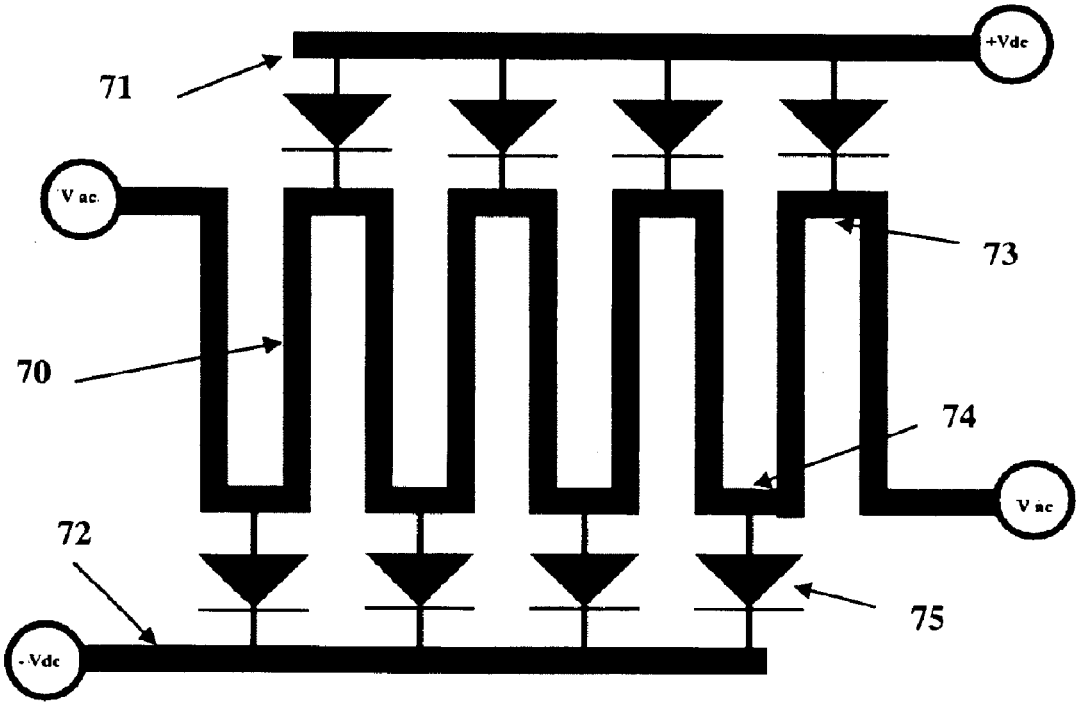
FIG. 7 illustrates one resistive heating element powered by either an alternating current or a direct current scheme.

FIG. 7 shows a power connection scheme for powering the resistive heating source by either an alternating current source or a direct current source. The alternating current, Iac, across each section of the heating element is equivalent to the direct current, Idc, across the same section. The number of sections needed depends on the AC and DC supply voltages. For example, in the case of a 110 VAC supply and an alternate 12 VDC supply, there should be approximately 10 equal resistance sections. The number of sections, N, is given by the formula, $$\frac{Vac}{(Vdc - 2 \times Vdiode)}$$

where Vac is the alternating current rms voltage,

Vdc is the direct current voltage source, and Vdiode is the diode voltage drop.

Ideally, these power diodes should have a peak inverse voltage of at least twice Vac (peak), low current leakage, low voltage drop and be capable of handling twice the current required by the section. The two VAC resistive element ends are kept short. Taking the example of a 220 W heater, which has a nominal rms current of 2 amperes, diodes should be rated to carry at least 4 amperes of direct current. These diodes can be in surface mount power packages. Solder or conductive adhesives in the case of PTF circuits can attach it to the bus bars 71, 72 (common power distribution conductors). The bus bar can either be a copper or PTF conductive ink trace. These bus bars must have low voltage drops, i.e., smaller than a diode voltage drop for passing a direct current of N×Irms.

When the resistive heating element is powered by alternating current, these diodes will block out the alternating current to other sections through the direct current bus bars 71, 72. Therefore, to the alternating current, each subsequent resistive element is electrically isolated. However, in the case of a direct current source, current flow in each section is parallel and maintains the equivalent amount of heat dissipation.

In one embodiment, a CUDD8-04 diode from Central Semiconductor Corp is used. This is an ultra fast rectifier capable of passing 8.0 A of forward current with protection against 400 Volts of repetitive peak reverse voltage. The whole family of rectifier is labeled by the letter "8" for forward current handling capability, and "-04" is the repetitive peak reverse voltage specification. The maximum reverse current is 5 microamperes. An alternate embodiment uses a general purpose rectifier like CMR3-04 which is 3.0 amps forward current and 400 repetitive peak reverse voltage. These are both in surface mount packages. These exemplary diodes are to be considered non-limiting; other diodes may be used.

This method can be extended to provide several different voltage sources by creating different heating sections and using a different set of diodes and bus bars for each voltage selection.

This use of the technology enables the setting of very uniform temperature over very irregularly shape objects and also applicable to very objects with extensive surface areas. Excellent heating efficiencies, easy customization of heated surfaces and its low cost in implementation lends this invention very useful. The diode-powering scheme allows the heater to be portable and lightweight since surface mount diodes are small.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A heating apparatus capable of operation under either direct or alternation current comprising:

a heating element;

a first set of electrical contacts connected to said heating element; and a second set of electrical contacts, each of said second set of electrical contacts connected via diodes to at least two locations on the heating element;

wherein the first set of electrical contacts are configured to receive alternating electrical current to heat the heating element to a first regulatable temperature and the second set of electrical contacts are configured to recieve direct electrical current to heat the heating element to a second regulatable temperature.

2. The apparatus of claim 1 wherein said first regulatable temperature is substantially the same as the second regulatable temperature.

3. The apparatus of claim 1 further comprising:

at least one thermally conductive film configured to provide an isothermal zone.

4. The apparatus of claim 1 wherein said at least one heating element comprises one of additive technology and subtractive technology.

5. A method of heating an electrical heating element using either direct or alternating current comprising:

providing a heating element;

selectively supplying either alternating electrical current to the heating element to heat the heating element to a first regulatable temperature, or delivering direct current via diodes to at least two different portions of the element to heat said heating element to a second regulatable temperature.

6. The method of claim 5 wherein the first regulatable temperature is substantially the same as the second regulatable temperature.

7. The method of claim 5 further comprising:

supplying at least one thermally conductive film configured to provide an isothermal zone.

8. A method of claim 5 wherein said heating element comprises one of additive technology and subtractive technology.

* * * * *